US009770646B1

(12) United States Patent
Wegener

(10) Patent No.: US 9,770,646 B1
(45) Date of Patent: Sep. 26, 2017

(54) SKATE ASSEMBLIES WITH QUICK RELEASE SYSTEMS AND RELATED METHODS

(71) Applicant: Power Scheme Industries Limited, Kowloon (HK)

(72) Inventor: Andreas C. Wegener, Encinitas, CA (US)

(73) Assignee: POWER SCHEME INDUSTRIES LIMITED, Kowloon (HK)

( * ) Notice: Subject to any disclaimer, the term of this patent is extended or adjusted under 35 U.S.C. 154(b) by 0 days.

(21) Appl. No.: 15/347,865

(22) Filed: Nov. 10, 2016

(51) Int. Cl.
*A63C 17/26* (2006.01)
*A63C 17/22* (2006.01)
*A63C 17/00* (2006.01)

(52) U.S. Cl.
CPC .... *A63C 17/226* (2013.01); *A63C 2017/0053* (2013.01)

(58) Field of Classification Search
CPC ... A63C 17/226; A63C 17/26; A63C 17/0006; A63C 2017/0053; A63C 17/0053; F16B 5/0004; F16B 5/0008; F16B 5/0012; F16B 5/0016
USPC ..... 280/11.221, 11.223; 403/292, 297, 294, 403/329
See application file for complete search history.

(56) References Cited

U.S. PATENT DOCUMENTS 5,299,815 A 4/1994 Brosnan et al.
5,400,484 A 3/1995 Gay
5,560,625 A * 10/1996 Kuykendall ..... A63C 17/01 280/11.204
5,947,487 A 9/1999 Keleny et al.
6,322,088 B1 11/2001 Klamer et al.
6,431,604 B1 * 8/2002 Goeckel ..... A63C 17/06 280/11.223
6,446,983 B1 9/2002 Gaster
6,698,768 B2 3/2004 Chun-Cheng et al.
7,246,803 B2 7/2007 Sauter et al.
7,464,944 B2 12/2008 Lyden
7,594,666 B2 * 9/2009 Wegener ..... A63C 17/06 280/11.12
8,353,535 B2 1/2013 Salmon et al.
8,613,453 B2 12/2013 Chen
(Continued)

FOREIGN PATENT DOCUMENTS

DE 199 55 053 A1 5/2001

*Primary Examiner* — John Walters
(74) *Attorney, Agent, or Firm* — Eric L. Lane; Green Patent Law

(57) ABSTRACT

Quick release systems and methods are provided which may be used with a skate assembly comprising a boot, a soul plate, and a grind plate. A first component, which may be a soul plate, has a tab and slot engagement mechanism. A second component, which may be a grind plate, defines at least one aperture and is engaged with at least a portion of the first component. At least one push button is accessible via the at least one aperture. When the second component is in an inward position it maintains the tab and slot engagement mechanism in a locked position and when the second component is in an outward position it unlocks the tab and slot engagement mechanism. When the push button is not pressed, it maintains the second component in the inward position and when the push button is pressed it facilitates movement of the second component to the outward position.

20 Claims, 15 Drawing Sheets

(56) References Cited

U.S. PATENT DOCUMENTS

| | | | |
|---|---|---|---|
| 8,777,235 | B2 | 7/2014 | Ng et al. |
| 8,915,502 | B2 | 12/2014 | Pennerath |
| 2002/0105154 | A1 | 8/2002 | Henselder |
| 2003/0038432 | A1 | 2/2003 | Chang |
| 2003/0062698 | A1 | 4/2003 | Gaster et al. |
| 2005/0029756 | A1 | 2/2005 | Lin et al. |
| 2010/0314846 | A1 | 12/2010 | Zeng |

* cited by examiner

SKATE ASSEMBLIES WITH QUICK RELEASE SYSTEMS AND RELATED METHODS

FIELD OF THE DISCLOSURE

The following disclosure relates to quick release devices, systems, and methods. The following disclosure further relates to skate assemblies with improved securing and releasing mechanisms.

BACKGROUND

There are a variety of different skates for recreational and professional skating which require different frames and wheels. Skates designed for free or recreational skating typically use tall and lightweight aluminum frames and 80 mm wheels with pointed profiles. Hockey frames are a bit lower (72-76 mm), and the wheel profiles more rounded. Aggressive skaters typically use lower plastic frames with diameters between about 56 and 72 mm.

Currently, changing frames and wheels is a big hassle. Especially with bigger wheels, the user must first remove the center wheels to access the frame bolts and then unfasten the bolts to change a frame or wheels. In many cases the user also must remove the liner to be able to counter the T-nuts inside the frame.

Accordingly, there is a need for a skate assembly that provides the ability to quickly and easily change frames, wheels, or other skate components. There is also a need for a quick release assembly and method for skates or other devices that will provide secure attachment of frames, wheels, soul plates, grind plates, and/or other components as well as quick release of those components.

SUMMARY

The present disclosure, in its many embodiments, alleviates to a great extent the disadvantages of known securing and release systems for skates or other devices by providing a tab and slot engagement mechanism together with a push button release mechanism. Exemplary skate assemblies have a tab and slot engagement to secure the soul plate to the bottom of the skate and two push buttons to prevent the grind plate from moving outwards. When the buttons are pressed, the grind plate slides outward and unlocks the tab and slot engagement so the soul plate can be removed and replaced.

Disclosed devices, systems and methods provide numerous advantages. In general, they provide the ability to quickly and easily remove and replace a soul plate or other component of a skate. Instead of having to unscrew and tighten multiple T-nuts or other conventional fasteners, the user need only push the buttons to release and exchange the soul plate. No tools are required. The user can employ a second, relatively inexpensive soul plate and mount the specific frames and wheels onto that. Advantageously, the user can change the complete soul plate, frames and wheels, e. g., between recreational and aggressive frames, in seconds with only the push of a couple of buttons.

With disclosed assemblies and methods, a user can have different types of soul plates for each specific style of skates. For recreational skates, the user doesn't need the wide wings that are used in aggressive skating, and a rider can buy fitness-specific soul plates that are flush with the boot. Whereas with existing skate assemblies, the user had to buy three different pairs of skates, now one can use the same boot for recreational, hockey and aggressive skates.

Exemplary embodiments of a skate assembly comprise a boot, a soul plate, and a grind plate. The boot has a heel part, a toe part, a bottom surface, and side surfaces. The soul plate is secured to the bottom surface of the boot by a tab and slot engagement mechanism. The tab and slot engagement mechanism comprises at least one tab on a rim of the soul plate and at least one corresponding slot on a lower side portion of the boot. The soul plate has at least one push button. The grind plate is engaged with a side surface of the boot and defines at least one aperture. The grind plate is engaged with a portion of the soul plate such that when the grind plate is in an inward position it maintains the tab and slot engagement mechanism in a locked position, thereby keeping the soul plate secured to the boot, and when the grind plate is in an outward position it unlocks the tab and slot engagement, thereby releasing the soul plate from the boot. The at least one push button is accessible via the at least one aperture such that when the push button is not pressed it maintains the grind plate in the inward position and when the push button is pressed it facilitates movement of the grind plate to the outward position.

In exemplary embodiments, the bottom surface of the boot comprises an extra bottom piece. The grind plate may be a single plate extending substantially the entire length of the bottom surface of the boot. Alternatively, the grind plate may comprise at least a first and second grind plate. In exemplary embodiments, the boot is made of a first material, the soul plate is made of a second material, and the second material is more rigid than the first material. In exemplary embodiments, the boot is made of a first material, the grind plate is made of a second material, and the second material is more rigid than the first material. In exemplary embodiments, the boot and the soul plate have peripheral rims for additional engagement. The grind plate may be generally L-shaped having a base portion and a side wall portion.

Exemplary embodiments of a quick release system comprise a first component having a tab and slot engagement mechanism and at least one push button and a second component defining at least one aperture and being engaged with at least a portion of the first component. The at least one push button is accessible via the at least one aperture. When the second component is in an inward position it maintains the tab and slot engagement in a locked position, and when the second component is in an outward position it unlocks the tab and slot engagement. When the push button is not pressed, it maintains the second component in the inward position, and when the push button is pressed it facilitates movement of the second component to the outward position.

In exemplary embodiments of a quick release system, the first component is a soul plate. In exemplary embodiments, the second component is a grind plate. The first component may be secured to the bottom surface of a boot. The grind plate may be a single plate extending substantially the entire length of the bottom surface of a boot. In exemplary embodiments, the boot is made of a first material, the soul plate is made of a second material, and the second material is more rigid than the first material.

Exemplary quick release methods comprise providing a first component having at least one push button, being locked by a tab and slot engagement mechanism, and engaging a second component with at least a portion of the first component. In exemplary embodiments, the second component defines at least one aperture. Exemplary methods further comprise positioning the second component in an inward position such that it maintains the tab and slot engagement in a locked position. The at least one push button is disposed in the at least one aperture such that when the push button is not pressed it maintains the second component in the inward position and when the push button is pressed it facilitates movement of the second component to the outward position. When the second component is in an outward position it unlocks the tab and slot engagement.

Exemplary methods further comprise pressing the push button and moving the second component to the outward position. In exemplary embodiments, the first component is a soul plate and the second component is a grind plate. Exemplary methods further comprise securing the soul plate to the bottom surface of a boot. Exemplary methods further comprise pressing the push button and moving the grind plate to the outward position. Exemplary methods further comprise removing the soul plate from the boot.

Accordingly, it is seen that skate assemblies, quick release systems and related methods are provided. The disclosed assemblies, systems, and methods provide a tab and slot engagement mechanism together with a push button release mechanism for quick and easy securing, release, and exchange of components. These and other features and advantages will be appreciated from review of the following detailed description, along with the accompanying figures in which like reference numbers refer to like parts throughout.

BRIEF DESCRIPTION OF THE DRAWINGS

The above-mentioned features and objects of the present disclosure will become more apparent with reference to the following description taken in conjunction with the accompanying drawings wherein like reference numerals denote like elements and in which.

DETAILED DESCRIPTION

In the following detailed description of embodiments of the disclosure, reference is made to the accompanying drawings in which like references indicate similar elements, and in which is shown by way of illustration specific embodiments in which disclosed systems, assemblies, devices and methods may be practiced. These embodiments are described in sufficient detail to enable those skilled in the art to practice the embodiments, and it is to be understood that other embodiments may be utilized and that logical, mechanical, functional, and other changes may be made without departing from the scope of the present disclosure. The following detailed description is, therefore, not to be taken in a limiting sense, and the scope of the present disclosure is defined only by the appended claims. As used in the present disclosure, the term "or" shall be understood to be defined as a logical disjunction and shall not indicate an exclusive disjunction.

Figure 1:
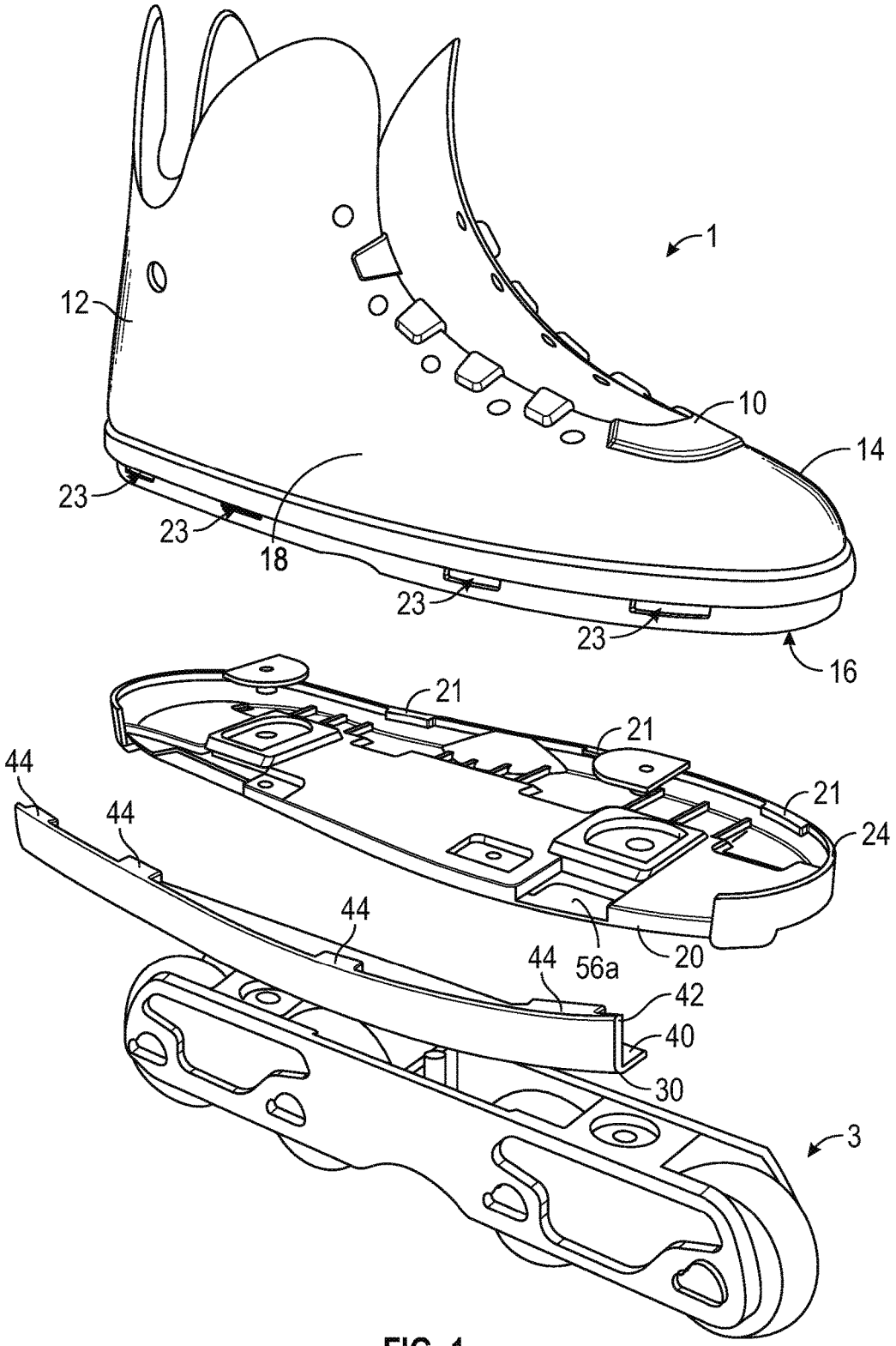
FIG. 1 is an exploded view of an exemplary embodiment of a skate assembly in accordance with the present disclosure.
Figure 2A:
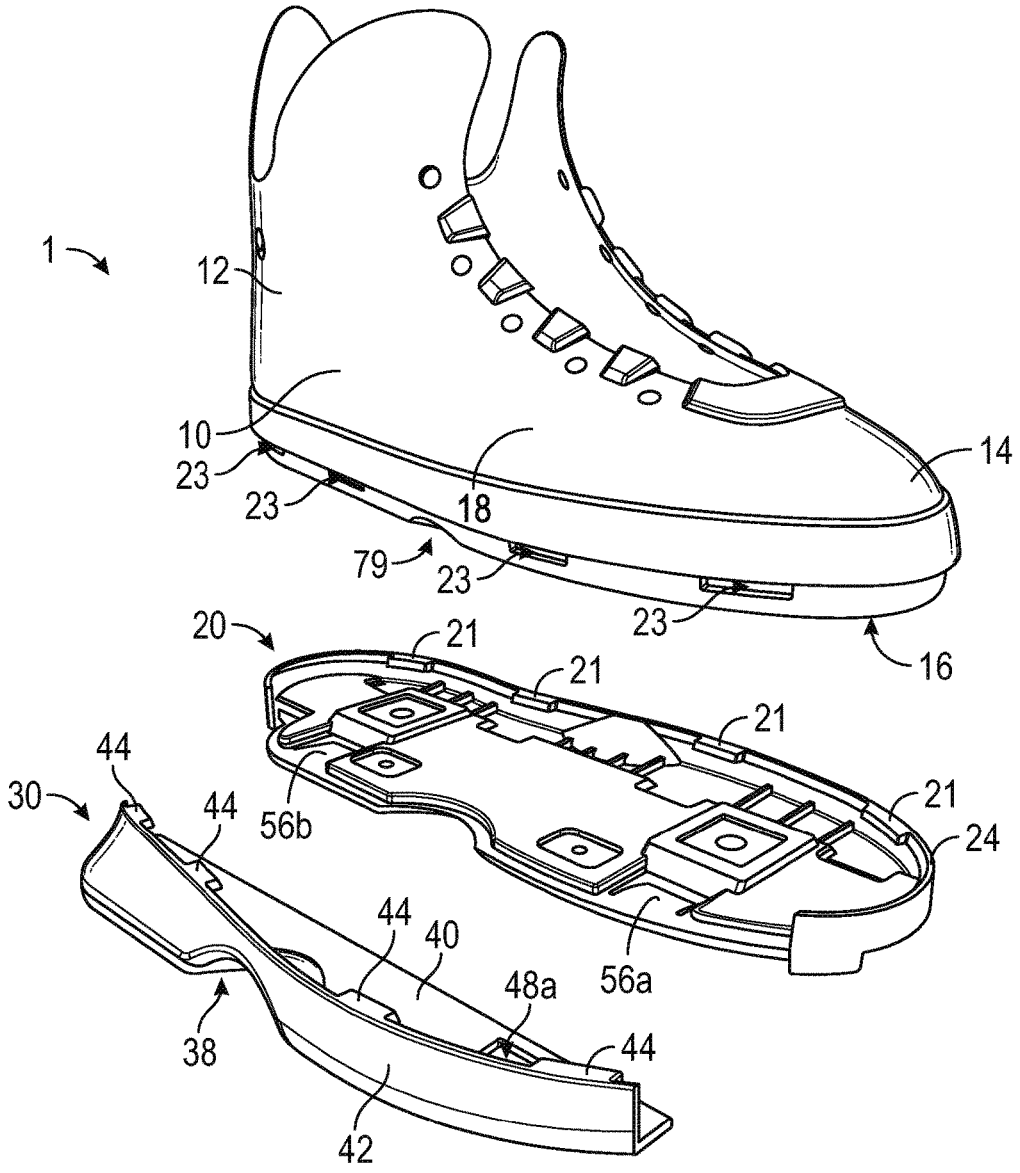
FIG. 2A is an exploded view of an exemplary embodiment of a skate assembly in accordance with the present disclosure.
Figure 2B:
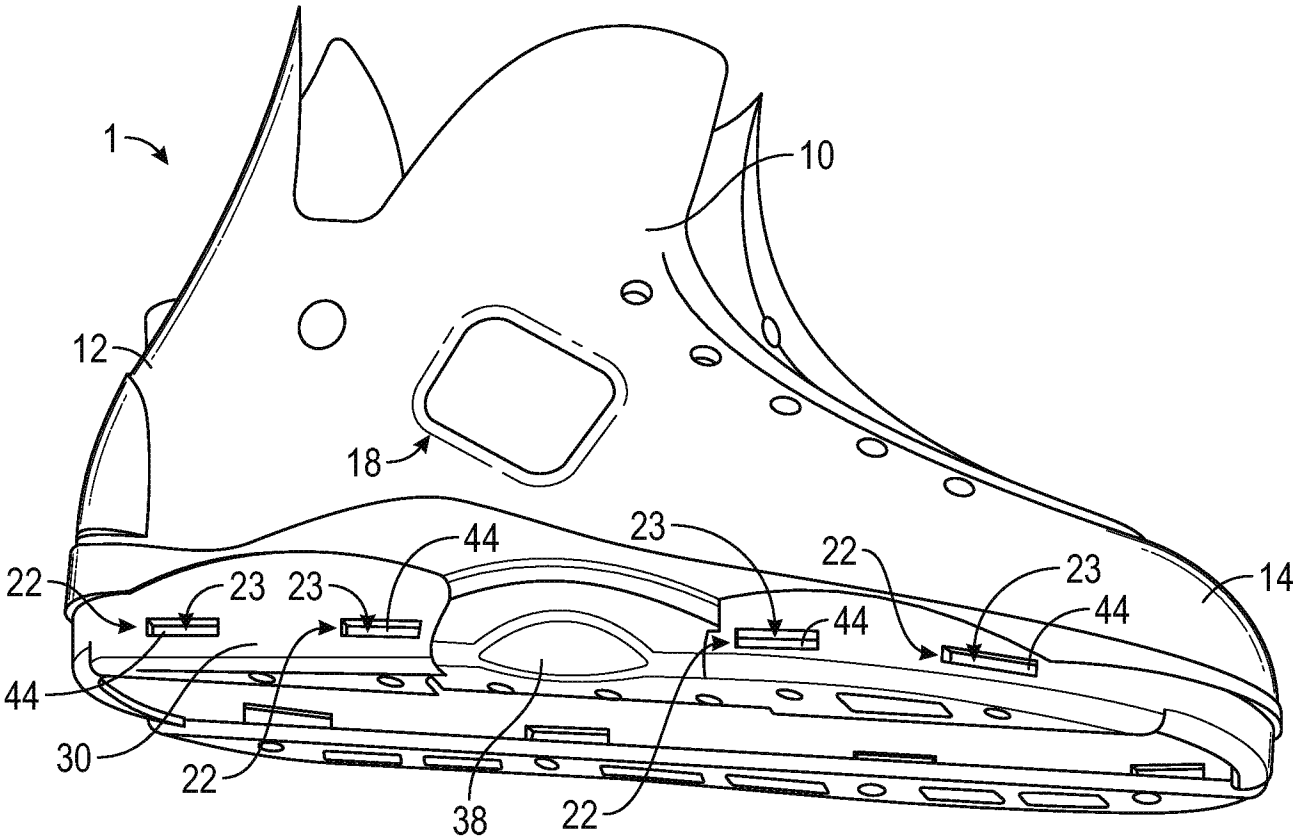
FIG. 2B is a first side perspective view of the skate assembly of FIG. 2A.
Figure 2C:
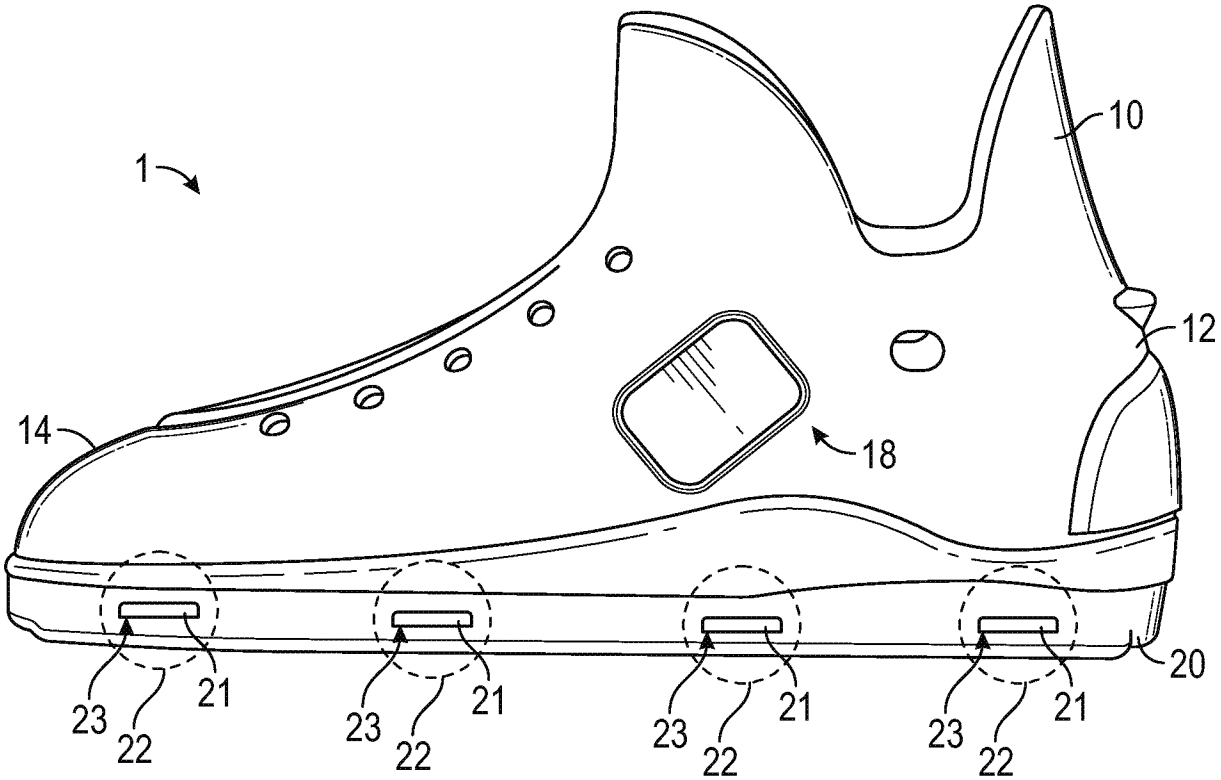
FIG. 2C is a second side perspective view of the skate assembly of FIG. 2A.

Referring to FIGS. 1-2C, exemplary embodiments of quick release systems and skate assemblies employing such systems will be described. It should be noted that disclosed systems and methods of securing multiple components and quickly releasing the components could be used in a wide range of applications, including different types of athletic shoes, ski and snowboarding equipment, scooters, and any type of roller skate or ice skate.

In exemplary embodiments, a first component 20 has a tab and slot engagement mechanism 22 for releasable attachment to the bottom of an athletic shoe or skate, and a second component 30 defines at least one aperture 48*a*. The second component 30 is engaged with at least a portion of the first component 20 such that when the second component 30 is in an inward position it maintains the tab and slot engagement mechanism 22 in a locked position. This keeps the first component 20 secured to the athletic shoe, skate, or other athletic device. By contrast, when the second component 30 is in an outward position, it unlocks the tab and slot engagement mechanism 22, thereby releasing the first component 20 from the athletic shoe, skate, or other athletic device. At least one push button 56*a* is provided and, when not pressed in, the push button maintains the second component 30 in the inward position. When push button 56*a* is pressed it facilitates movement of the second component 30 to the outward position.

In exemplary embodiments, the securing and quick release systems are used for a skate assembly. The skate assembly may be an in-line skate with the gliding device comprising a frame with a row of wheels or rollers rotatably mounted on the frame, a conventional roller skate with a frame carrying a line or spaced pairs of aligned rollers 3, or an ice skate with a blade. As shown in FIGS. 1-5, skate assembly 1 comprises a boot 10 with a rear section or heel part 12, a front section or toe part 14, a bottom surface 16, and side surfaces 18. Exemplary embodiments include a soul plate 20, which may be secured to the bottom surface 16 of the boot 10 by a tab and slot engagement mechanism 22 including slots 23 in the bottom side surfaces of the boot, best seen in FIG. 3. More particularly, the soul plate 20 may be releasably attached to the bottom surface 16, or base, of the boot 10 so it extends over a majority portion of the bottom surface.

The soul plate 20 provides a grinding surface which is adapted to engage and slide along a sliding surface during sliding maneuvers. Because skate boots typically are made of relatively soft material which is too flexible for direct interface with the glide frame of the skate, the rigid soul plate of stronger, faster sliding material is secured over the base of the boot to provide an interface between the boot and a grind plate. The soul plate 20 may be made of any suitable hard and substantially rigid material, such as fiber reinforced nylon or the like, which will be resistant to wear and abrasion. In exemplary embodiments, the soul plate 20 is releasably secured over the base of the boot and can be removed and replaced if the surfaces become too worn over time due to sliding or grinding maneuvers.

The upper and lower faces of an exemplary soul plate 20 are illustrated in more detail in FIGS. 1, 2A and 6-8. The peripheral shape and dimensions of the soul plate 20 may be designed to substantially match those of the bottom surface 16 of the boot 10. In exemplary embodiments, the soul plate has a raised peripheral rim 24 which extends along its inner side edge, toe, and heel. A plurality of tabs 21 are provided as part of the tab and slot engagement mechanism 22. As discussed in more detail herein, the tabs 21 are positioned for mating engagement in the corresponding slots 23 in the inner side rim of the boot 10 when the soul plate 20 is engaged over the bottom surface 16 of the boot 10.

Fastener openings could be provided along opposite side portions of the sole plate for alignment with corresponding fastener openings in the side edge of the base of the boot, but, as discussed herein, additional fasteners are not necessary due to the combination of the push buttons and the tab and slot engagement mechanism. The inner side edge of the soul plate 20 may have an indent or cutout for alignment with a side of the boot 10 which is designed to receive a backslide grind plate, and a reduced height rim extending to the toe and heel regions of the soul plate 20. In exemplary embodiments, the corresponding groove of the backslide plate is incorporated in the grind plate. In exemplary embodiments, the soul plate is made of a rigid, more wear-resistant material than that of the boot.

As best seen in FIGS. 1, 2A, 8, and 8A, in exemplary embodiments a grind plate 30 is provided and is engaged with a side surface 18 of the boot 10. More particularly, at least one grind plate 30 engages over a first side 18 of the boot 10 and over soul plate 20. The grind plate 30 provides a grinding surface to engage a sliding surface during sliding maneuvers. More particularly, grind plate 30 provides a hard, relatively smooth outer sliding or grinding face, which a skater can use to slide against a suitable edge such as a rail, sidewalk edge, or the like. In addition to providing the user with a grinding or sliding surface for sliding maneuvers, grind plate 30 helps to hold the soul plate firmly in position on the base of the boot 10. In exemplary embodiments, grind plate 30 is a single plate, and it extends substantially the entire length of the bottom surface 16 of the boot 10. Alternatively, as shown in FIG. 9, a series of grind plates may be provided including a front grind plate 32, a backslide grind plate 34, and a rear grind plate 36. Backslide grind plate 34, or the single, longer grind plate 30, may have a concave, arcuate slide face 38. It also should be noted that the grind/slide surfaces could be formed integrally with the soul plate.

In exemplary embodiments, grind plate 30 has a generally L-shaped profile with a base wall or leg 40 and an upstanding side wall or leg 42. In exemplary embodiments, the grind plate 30 also employs a tab and slot engagement mechanism. The lower portion of the side 18 of the boot 10 may have one or more slots 23 and the side wall portion 42 of the grind plate 30 may have one or more tabs 44 for releasable mating engagement in the slots 23. More particularly, the side wall 42 of grind plate 30 has two spaced, inwardly directed tabs 44 designed for mating engagement in the corresponding slots 23 in the outer side rim of the boot 10. The base wall 40 of grind plate 30 defines at least one aperture. In exemplary embodiments, base wall 40 of grind plate 30 has a pair of spaced apertures 48*a*, 48*b* designed for alignment with corresponding openings 50*a*, 50*b* in the bottom surface 16 of the boot 10 and openings 52*a*, 52*b* in the soul plate 20, respectively. In exemplary embodiments, the one or more grind plates are made of a rigid, durable, and abrasion resistant material such as fiber reinforced nylon or the like. The material of the grind plates is therefore more rigid than the material of the boot.

Figure 3:
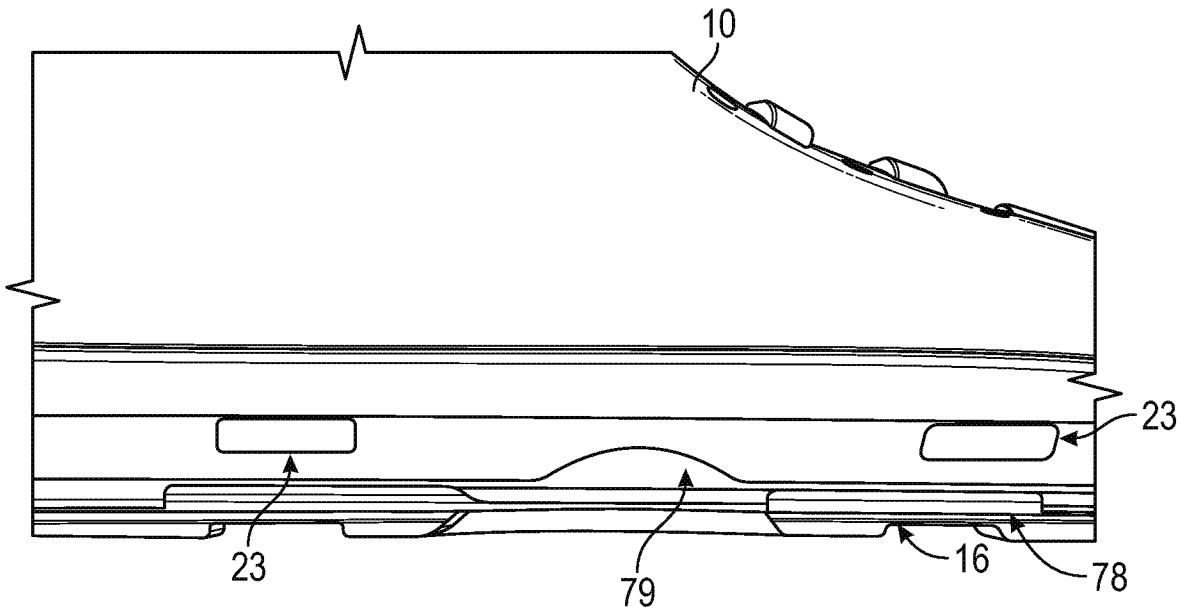
FIG. 3 is a detail view of an exemplary embodiment of a boot in accordance with the present disclosure.
Figure 4:
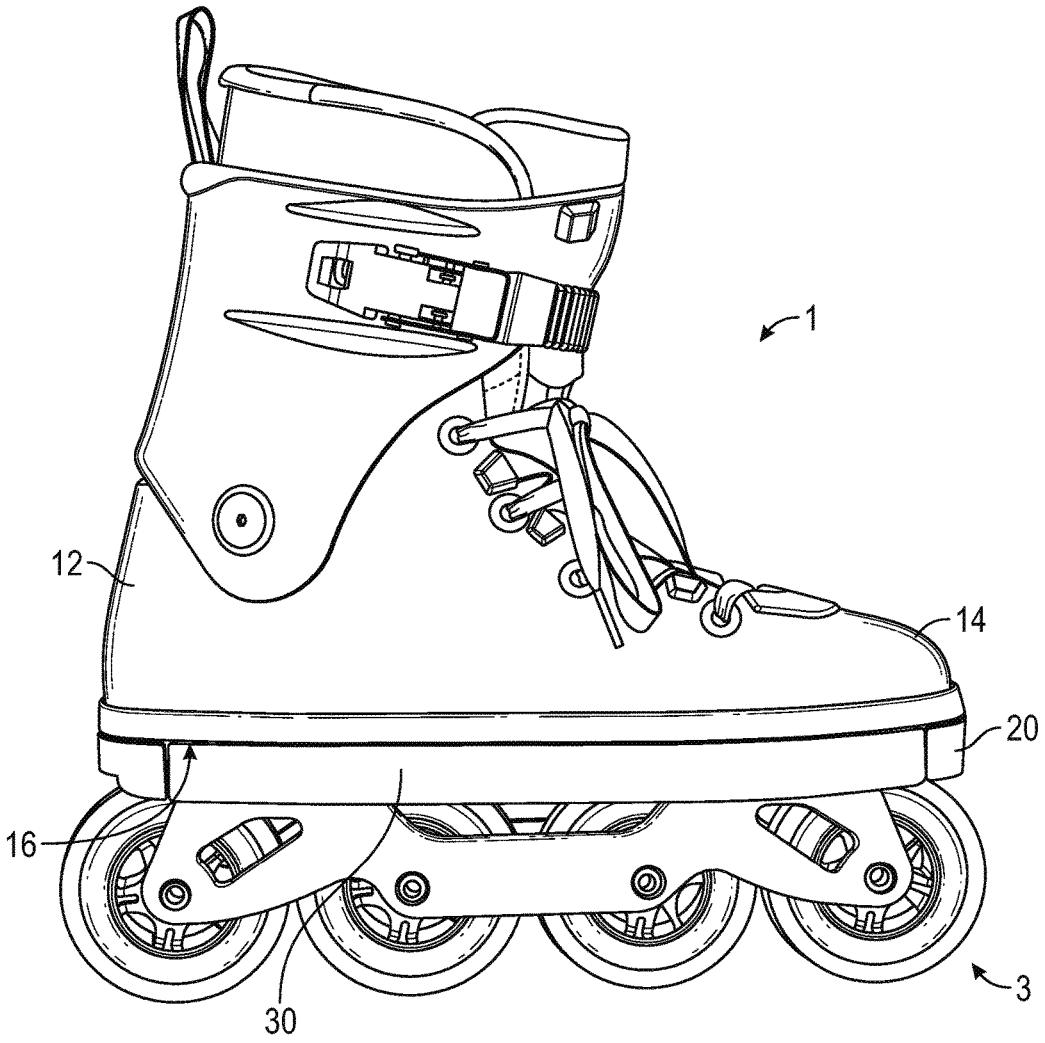
FIG. 4 is a side perspective view of an exemplary embodiment of a skate assembly in accordance with the present disclosure.
Figure 5:
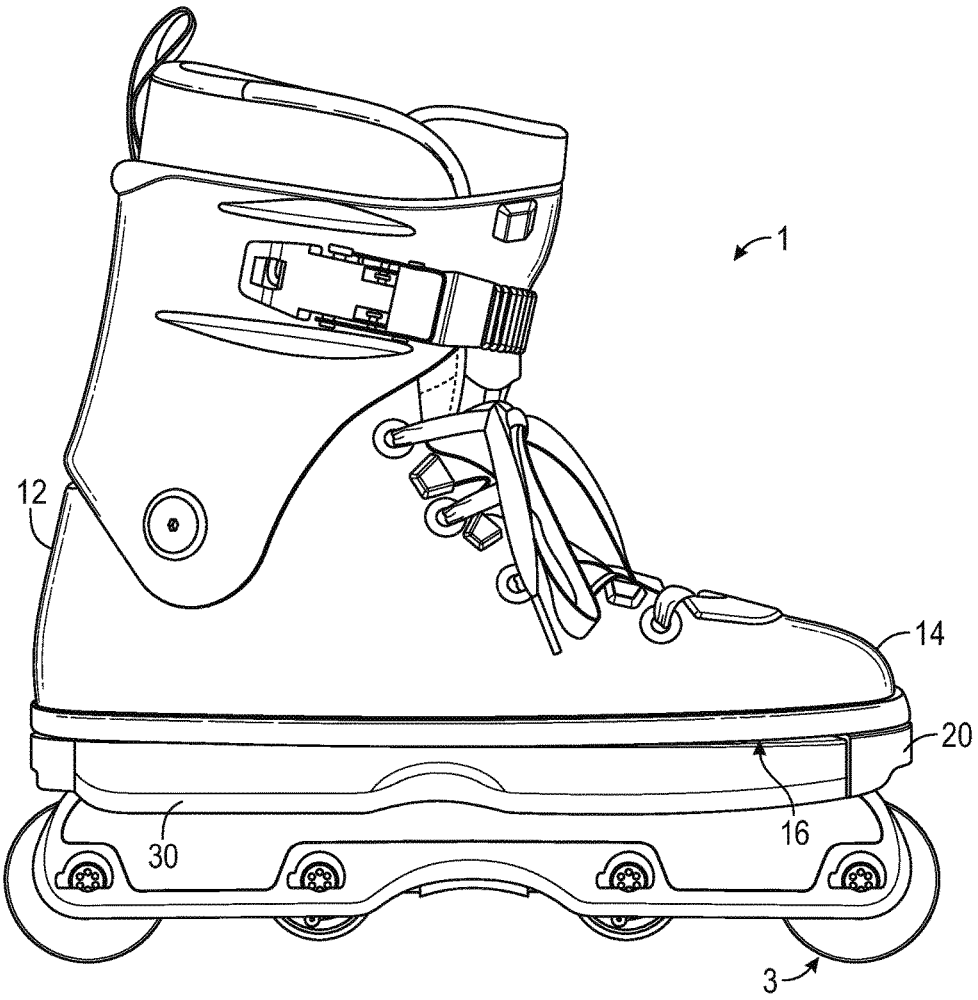
FIG. 5 is a side perspective view of an exemplary embodiment of a skate assembly in accordance with the present disclosure.
Figure 6:
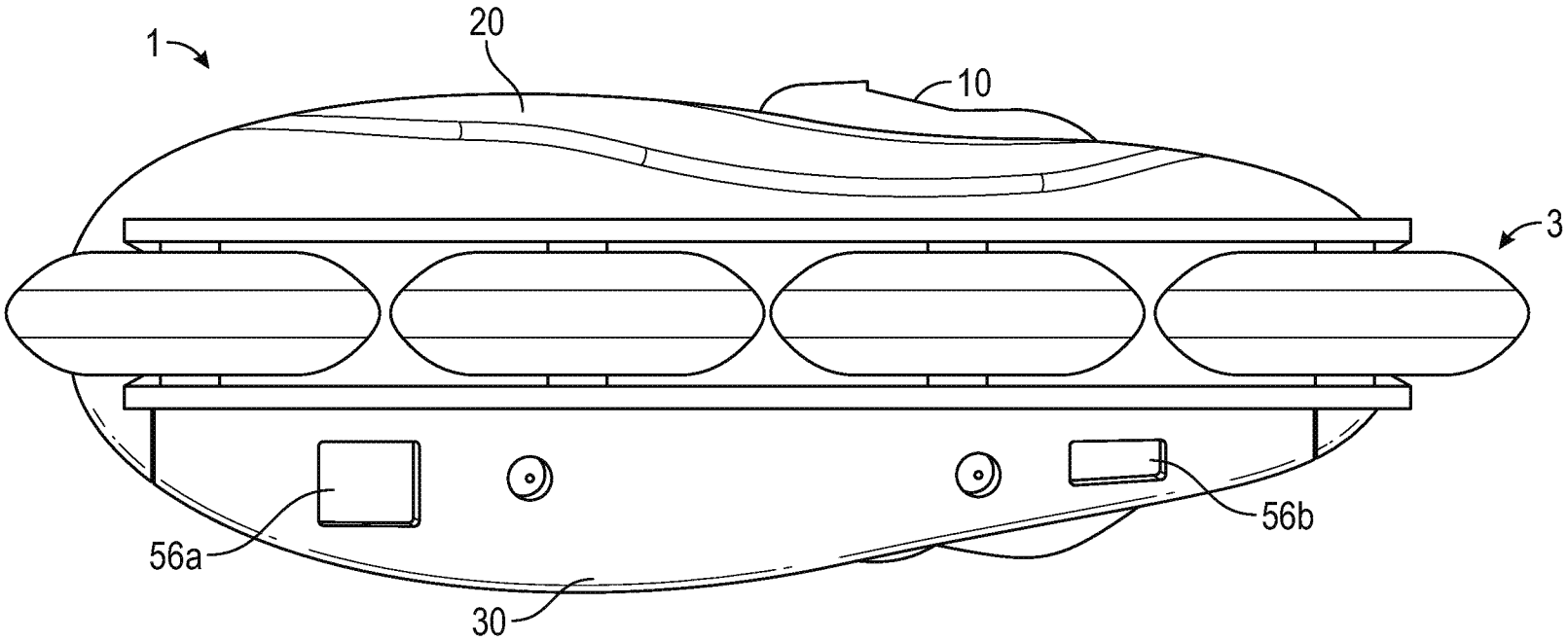
FIG. 6 is a bottom view of an exemplary embodiment of a skate assembly in accordance with the present disclosure.
Figure 7:
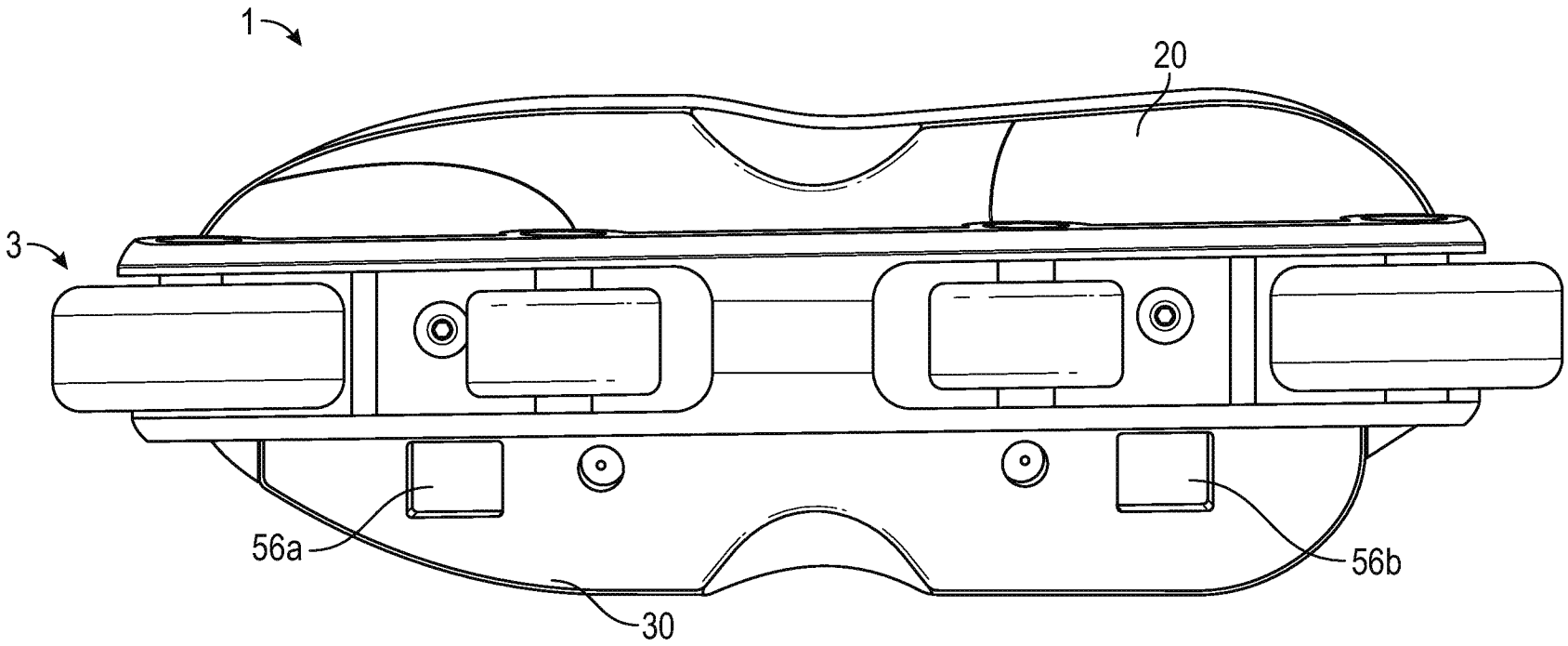
FIG. 7 is a bottom view of an exemplary embodiment of a skate assembly in accordance with the present disclosure

Referring to FIG. 3, in exemplary embodiments a reduced thickness stitching groove 78 extends around the peripheral rim of the boot 10. A recessed region 79 may also be provided in a central region of the outer side of the rim, for receiving the grind plate 30 or, in the case of multiple grind plates, backslide grind plate 34.

Figure 10:
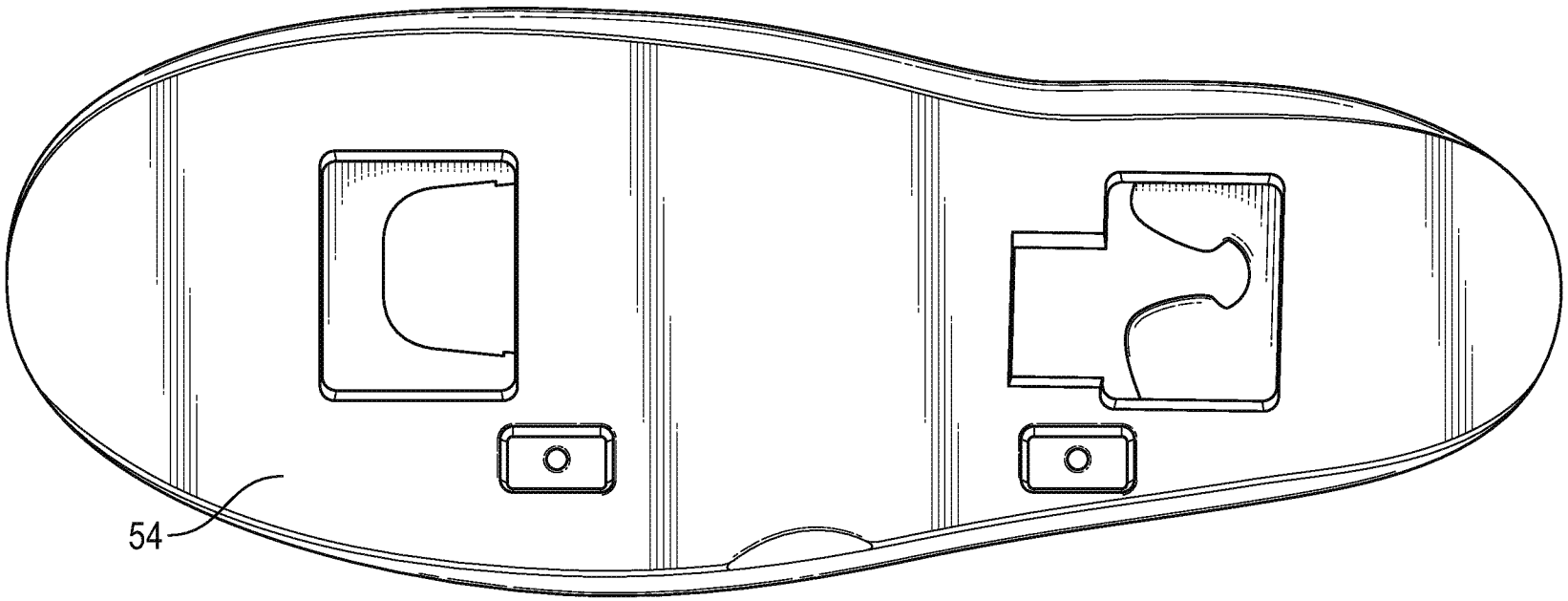
FIG. 10 is a bottom view of an exemplary embodiment of a bottom piece for a skate assembly in accordance with the present disclosure.

As described in more detail herein, the soul plate 20 and either the single grind plate 30, or multiple grind plates 32, 34, 36, are releasably secured to the boot 10, so that any one or more of these components can be removed and replaced as needed, for example if they become worn or too scuffed. As shown in FIG. 10, exemplary embodiments may also include an extra bottom piece 54 engaged with the bottom surface 16 of the boot 10 between the boot and the soul plate 20. More particularly, a thin bottom piece 54 may be provided to prevent the flexible boot material from bowing outwards during skate maneuvers which might result in disengaging of the soul plate and boot.

Turning to FIGS. 11-14B, exemplary securing and releasing systems and methods will now be described. Exemplary embodiments advantageously are designed so grind plate 30 is engaged with a portion of soul plate 20 such that when the grind plate 30 is in an inward position it maintains the tab and slot engagement mechanism 22 in a locked position. This keeps the soul plate 20 secured to the boot 10. By contrast, when grind plate 30 is in an outward position, it unlocks the tab and slot engagement mechanism 22, thereby releasing the soul plate 20 from the boot 10. At least one push button 56*a* is provided on the soul plate 20 and, when not pressed in, the push button maintains grind plate 30 in the inward position. When push button 56*a* is pressed it facilitates movement of the grind plate 30 to the outward position.

Figure 8:
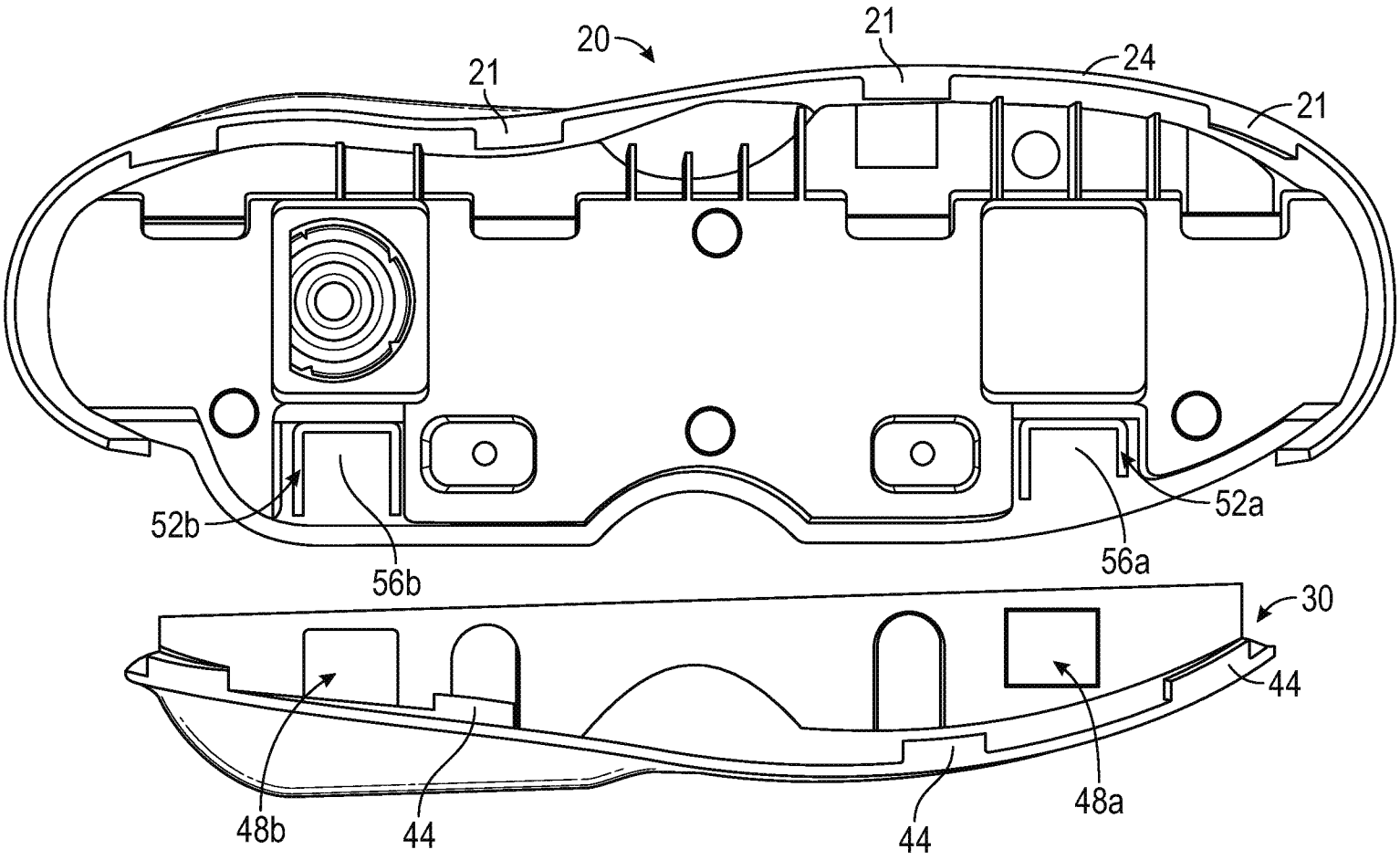
FIG. 8 is a top view of an exemplary embodiment of a soul plate and a grind plate in accordance with the present disclosure.
Figure 8A:
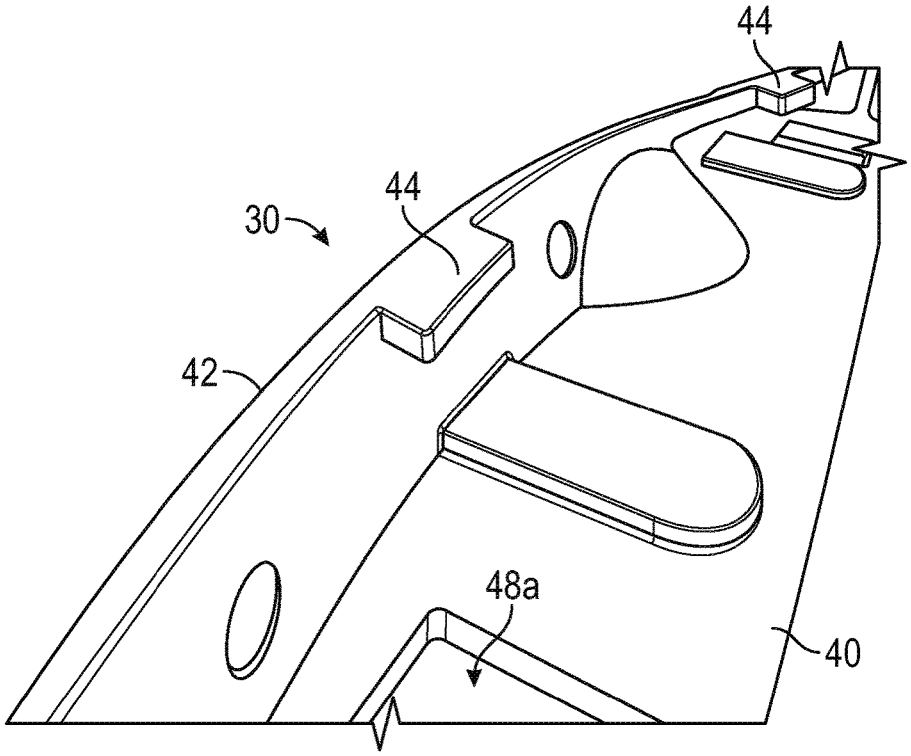
FIG. 8A is a detail view of the grind plate of FIG. 8.
Figure 9:
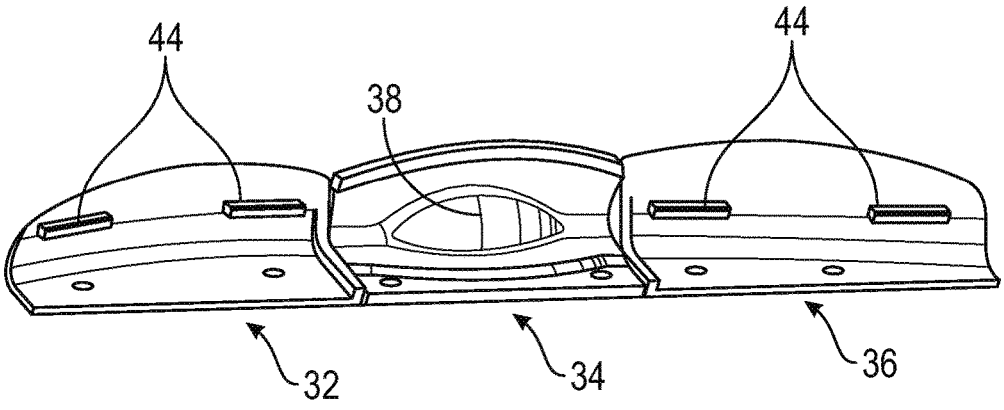
FIG. 9 is a perspective view of an exemplary embodiment of a series of grind plates in accordance with the present disclosure.
Figure 12:
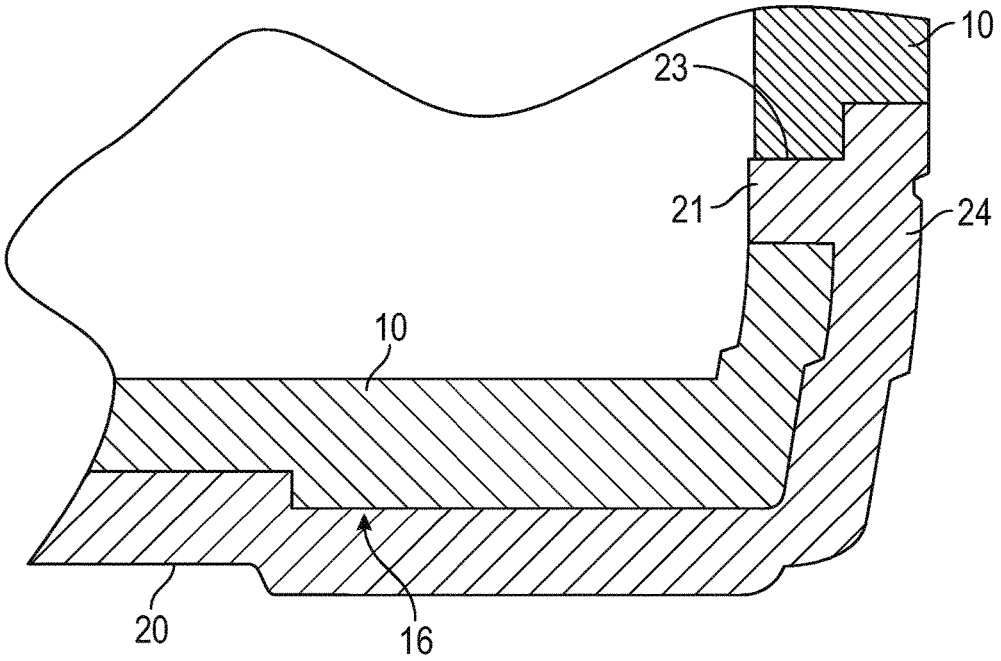
FIG. 12 is a first side cross-sectional view of an exemplary embodiment of a tab and slot engagement mechanism in accordance with the present disclosure.
Figure 13:
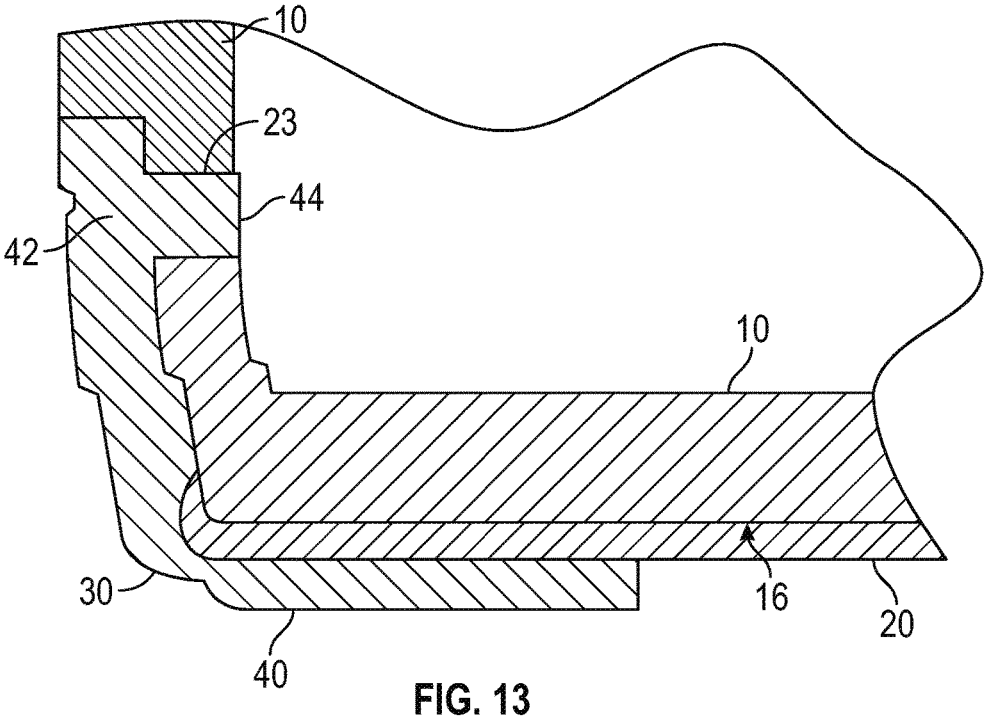
FIG. 13 is a second side cross-sectional view of an exemplary embodiment of a tab and slot engagement mechanism in accordance with the present disclosure.

In exemplary embodiments, a series of four inwardly directed tabs 21 are provided on the inner side of the rim 24 of the soul plate 20, as illustrated in FIGS. 1, 2A and 8. The tabs 21 are positioned for mating engagement in the corresponding slots 23 in the inner side rim of the boot 10 when the soul plate 20 is engaged over the bottom surface 16 of the boot 10, as best seen in FIG. 12. More particularly, the tabs 21 snap into the corresponding slots 23 when the soul plate is engaged over the base of the boot 10 with the side rims 24 engaging over the corresponding bottom side 18 of the boot 10. The push buttons 56*a*, 56*b* are disposed within respective apertures 48*a*, 48*b* of grind plate 30, openings 52*a*, 52*b* of soul plate 20, and openings 50*a*, 50*b* of the bottom surface 16 of the boot 10.

Figure 11:
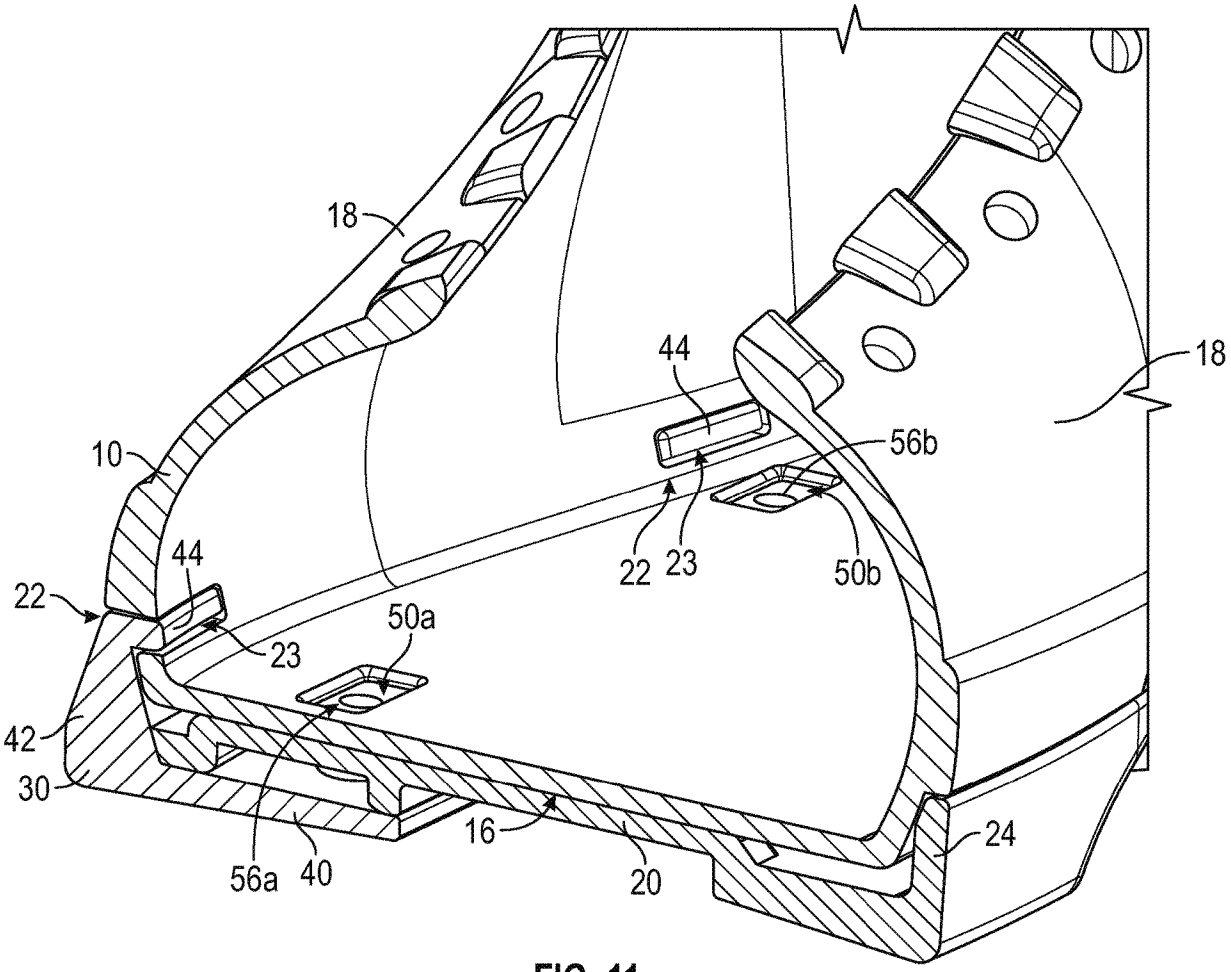
FIG. 11 is a transverse sectional view of an exemplary embodiment of a quick release system used in a skate assembly in accordance with the present disclosure.

Advantageously, the combination of the tab and slot engagement mechanism 22 between the soul plate 20 and the boot 10 and the push button engagement between the grind plate 30 and the boot 10 on the side of the boot will firmly hold the soul plate 20 in position over the base of the boot 10. The grind plate 30 holds the boot 10 and soul plate 20 firmly together along the outside of the boot, as seen in FIG. 11, with the tab and slot engagement mechanism 22 holding these parts together along the other side of the boot 10. The tab and slot engagement mechanism 22 holds soul plate 20 and boot 10 together, and, with the push button mechanism, all the parts are held in the proper position with the push buttons 56*a*, 56*b* disposed through the spaced apertures 48*a*, 48*b* in the grind plate 30, through corresponding openings 52*a*, 52*b* in the soul plate 20, and through corresponding openings 50*a*, 50*b* in the bottom surface 16 of the boot 10. The push buttons 56*a*, 56*b* extending through the aligned apertures 56*a*, 56*b* and openings 50*a*, 50*b*, 52*a*, 52*b* prevent accidental separation of these components during use of the skate 1.

In operation, a user of a skate assembly 1, or other athletic footwear or device, can employ a quick release method by initially securing the soul plate 20 to the bottom surface 16 of the boot 10. More particularly, the user holds the soul plate 20 firmly against the bottom surface 16 of the boot 10 so the inner side of rim 24 of the soul plate 20 lines up with the corresponding bottom side 18 of the boot 10. The user then snaps each of the series of four inwardly directed tabs 21 of the soul plate 20 into the corresponding slots 23 of the boot 10 so the tabs and slots matingly engage and the tab and slot engagement mechanism 22 locks.

The user then positions the grind plate 30 with its side wall 42 on one side of the boot 10 and its base wall 40 underneath a portion of the soul plate 20. More particularly, grind plate 30 is positioned such that tabs 44 on the side wall 42 of the grind plate are aligned with corresponding slots 23 in the outer side rim of the boot 10 and the spaced apertures 48*a*, 48*b* are aligned with corresponding openings 50*a*, 50*b* in the bottom surface 16 of the boot 10 and openings 52*a*, 52*b* in the soul plate 20. The user then snaps the tabs 44 into the slots 23 and positions each of the push buttons 56*a*, 56*b* so they are disposed within respective apertures 48*a*, 48*b*, openings 50*a*, 50*b*, and openings 52*a*, 52*b*.

Figure 14A:
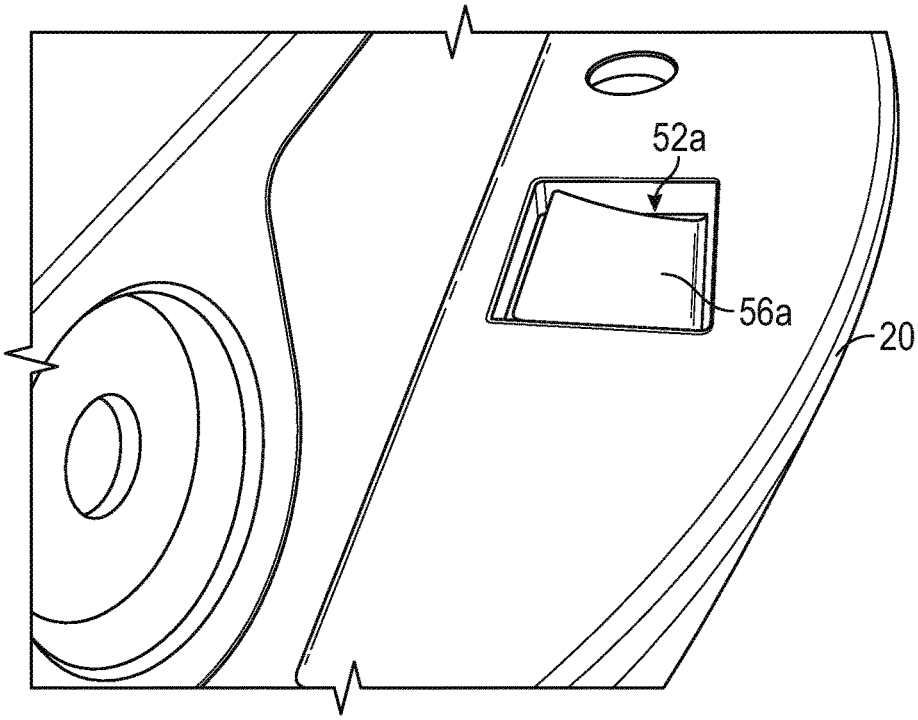
FIG. 14A is a perspective view of an exemplary embodiment of a push button in accordance with the present disclosure.

Having done this, the grind plate 30 is now engaged with both the soul plate 20 via the push buttons 56*a*, 56*b* and the boot 10 via tabs 44 and slots 23. So long as the user maintains the grind plate 30 in this inward position with the push buttons 56*a*, 56*b* in their unpressed positions, as best seen in FIG. 14A, it will firmly hold the soul plate 20 in position over the base of the boot 10 and hold all the components in proper position. This is because the adjoining of the grind plate 30 with the boot 10 and the soul plate 20 ensures that none of these components can be pulled apart without pressing the push buttons 56*a*, 56*b*, and the tab and slot mechanism 22 therefore remains locked. More particularly, the tabs 21 of the soul plate 20 are kept tightly disposed within the corresponding slots 23 of the boot 10 so they cannot move out of the slots. In addition, the tabs 44 of the side wall 42 of the grind plate 30 are kept tightly disposed within the corresponding slots 23 in the outer side rim of the boot 10.

Figure 14B:
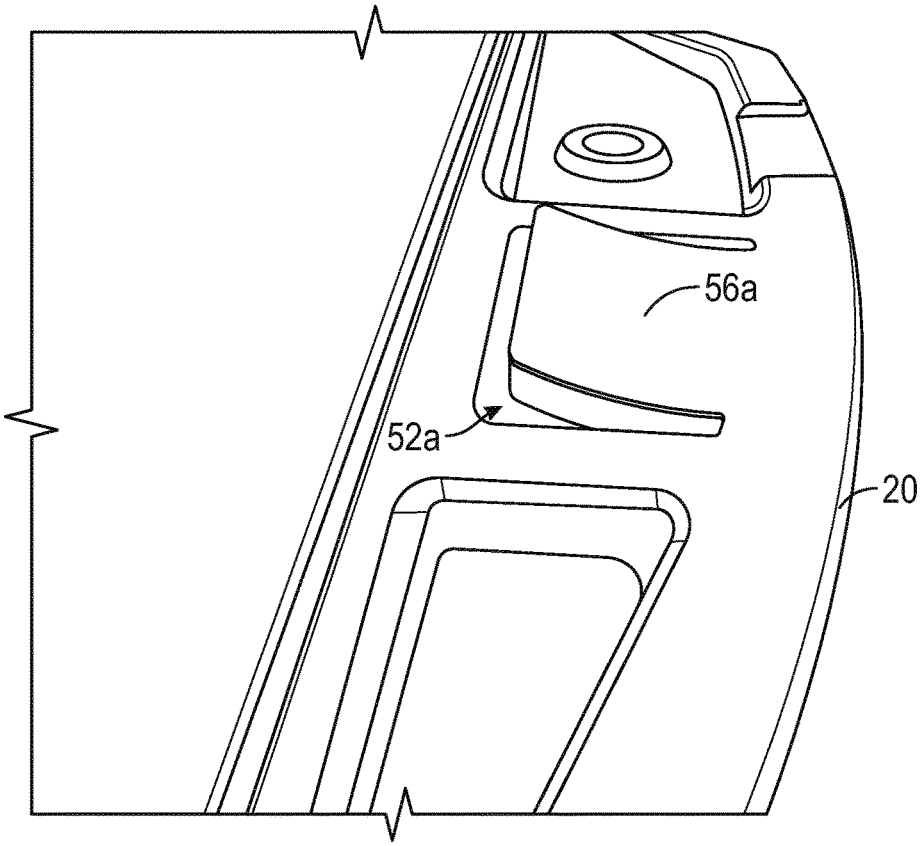
FIG. 14B is a perspective view of an exemplary embodiment of a push button in accordance with the present disclosure.

Should the user wish to detach any of the components to replace a worn soul plate or grind plate, for example, the user first presses in the push buttons 56*a*, 56*b*. More particularly, the push buttons 56*a*, 56*b* are pressed so they move out of their positions within respective apertures 48*a*, 48*b* of the grind plate 30, openings 50*a*, 50*b* of the boot 10, and openings 52*a*, 52*b* of the soul plate 20. With the push buttons 56*a*, 56*b* in the pressed position, as shown in FIG. 14B, the grind plate 30 can now be moved. Then the user slides or pulls the grind plate 30 to an outward position. Due to this movement to the outward position, the grind plate 30 unlocks the tab and slot engagement.

More particularly, when the grind plate 30 is in the outward position, gentle movement or manipulation of the soul plate 20 facilitates removal of the four inwardly directed tabs 21 of the soul plate 20 from the corresponding slots 23 of the boot 10 so the tabs and slots disengage and the tab and slot engagement mechanism 22 unlocks. The user can then remove the soul plate 20. With the grind plate 30 in the outward position, the user could also easily remove the grind plate 30 by moving it such that the tabs 44 on the side wall 42 of the grind plate slide out of the corresponding slots 23 in the outer side rim of the boot 10. The user can then attach a different soul plate and/or a different grind plate as needed by performing the steps described above.

Thus, it is seen that systems and methods of securing and quickly releasing components and skate assemblies incorporating such systems and methods are provided. It should be understood that any of the foregoing configurations and specialized components or chemical compounds may be interchangeably used with any of the systems and methods of the preceding embodiments. Although illustrative embodiments are described hereinabove, it will be evident to one skilled in the art that various changes and modifications may be made therein without departing from the disclosure. It is intended in the appended claims to cover all such changes and modifications that fall within the true spirit and scope of the disclosure.

While the assemblies, systems, and methods have been described in terms of what are presently considered to be the most practical embodiments, it is to be understood that the disclosure need not be limited to the disclosed embodiments. It is intended to cover various modifications and similar arrangements included within the spirit and scope of the claims, the scope of which should be accorded the broadest interpretation so as to encompass all such modifications and similar structures. The present disclosure includes any and all embodiments of the following claims.

The invention claimed is:

1. A skate assembly comprising:

a boot having a heel part, a toe part, a bottom surface, and side surfaces;

a soul plate secured to the bottom surface of the boot by a tab and slot engagement mechanism, the soul plate having at least one push button;

a grind plate engaged with a side surface of the boot and defining at least one aperture, the grind plate being engaged with a portion of the soul plate such that when the grind plate is in an inward position the tab and slot engagement mechanism is maintained in a locked position, thereby keeping the soul plate secured to the boot, and when the grind plate is in an outward position the tab and slot engagement mechanism is unlocked, thereby releasing the soul plate from the boot;

the at least one push button being accessible via the at least one aperture such that when the push button is not pressed the push button maintains the grind plate in the inward position and when the push button is pressed the push button facilitates movement of the grind plate to the outward position.

2. The skate assembly of claim 1 wherein the bottom surface of the boot comprises an extra bottom piece.

3. The skate assembly of claim 1 wherein the grind plate is a single plate extending substantially the entire length of the bottom surface of the boot.

4. The skate assembly of claim 1 wherein the boot is made of a first material and the soul plate is made of a second material, the second material being more rigid than the first material.

5. The skate assembly of claim 1 wherein the boot is made of a first material and the grind plate is made of a second material, the second material being more rigid than the first material.

6. The skate assembly of claim 1 wherein the tab and slot engagement mechanism comprises at least one tab on a rim of the soul plate and at least one corresponding slot on a lower side portion of the boot.

7. The skate assembly of claim 1 wherein the grind plate is generally L-shaped having a base portion and a side wall portion.

8. The skate assembly of claim 1 wherein the grind plate comprises at least a first and second grind plate.

9. A quick release system comprising:

a first component having a tab and slot engagement mechanism and at least one push button; and a second component defining at least one aperture and being engaged with at least a portion of the first component, the at least one push button being accessible via the at least one aperture;

wherein when the second component is in an inward position the tab and slot engagement is maintained in a locked position and when the second component is in an outward position the tab and slot engagement is unlocked;

wherein when the push button is not pressed the push button maintains the second component in the inward position and when the push button is pressed the push button facilitates movement of the second component to the outward position.

10. The system of claim 9 wherein the first component is a soul plate.

11. The system of claim 10 wherein the second component is a grind plate.

12. The system of claim 11 wherein the grind plate is a single plate extending substantially the entire length of the bottom surface of a boot.

13. The system of claim 10 wherein the first component is secured to the bottom surface of a boot.

14. The system of claim 13 wherein the boot is made of a first material and the soul plate is made of a second material, the second material being more rigid than the first material.

15. A quick release method comprising:

providing a first component locked by a tab and slot engagement mechanism, the first component having at least one push button;

engaging a second component with at least a portion of the first component, the second component defining at least one aperture;

positioning the second component in an inward position such that the tab and slot engagement mechanism is maintained in a locked position;

disposing the at least one push button in the at least one aperture such that when the push button is not pressed the push button maintains the second component in the inward position and when the push button is pressed the push button facilitates movement of the second component to the outward position;

wherein when the second component is in an outward position the tab and slot engagement mechanism is unlocked.

16. The method of claim 15 further comprising pressing the push button and moving the second component to the outward position.

17. The method of claim 15 wherein the first component is a soul plate and the second component is a grind plate.

18. The method of claim 17 further comprising securing the soul plate to the bottom surface of a boot.

19. The method of claim 18 further comprising pressing the push button and moving the grind plate to the outward position.

20. The method of claim 19 further comprising removing the soul plate from the boot.

* * * * *